US005503442A

United States Patent [19]

Lee

[11] Patent Number: 5,503,442

[45] Date of Patent: Apr. 2, 1996

[54] PICK-UP DEVICE FOR PICKING UP ANIMAL FECES

[76] Inventor: Ke-Chiang Lee, 7F, No. 3, Lane 50, Tun Hua N. Road, Taipei, Taiwan

[21] Appl. No.: 421,678

[22] Filed: Apr. 12, 1995

Related U.S. Application Data

[63] Continuation-in-part of Ser. No. 347,728, Dec. 1, 1994.

[51] Int. Cl.[6] ..... A01K 29/00

[52] U.S. Cl. ..... 294/1.4

[58] Field of Search ..... 294/1.3–1.5, 19.1, 294/50.8, 55, 115; 15/104.8, 257.1, 257.2, 257.6

[56] References Cited

U.S. PATENT DOCUMENTS

| | | | |
|---|---|---|---|
| 3,560,039 | 2/1971 | Gruber | 294/1.3 |
| 3,659,891 | 5/1972 | Pettenon et al. | 294/1.4 |
| 4,119,337 | 10/1978 | Sherhandt | 294/1.4 |
| 4,243,259 | 1/1981 | Wright | 294/1.3 |
| 4,248,468 | 2/1981 | Hastings | 294/1 BA |
| 4,641,873 | 2/1987 | Nurnberger | 294/1.4 |
| 4,717,186 | 1/1988 | Yoshioka | 294/1.5 |
| 4,854,624 | 8/1989 | Baymiller | 294/1.3 |
| 4,896,912 | 1/1990 | Parnell | 294/1.3 |
| 4,958,871 | 9/1990 | Hemans | 294/1.4 |

FOREIGN PATENT DOCUMENTS

| | | | |
|---|---|---|---|
| 2613740 | 10/1988 | France | 294/1.4 |
| 2683139 | 5/1993 | France | 294/1.3 |
| 93/13268 | 7/1993 | WIPO | 294/1.4 |
| 93/20285 | 10/1993 | WIPO | 294/1.4 |

*Primary Examiner*—Dean Kramer
*Attorney, Agent, or Firm*—Fish & Richardson

[57] ABSTRACT

A pick-up device for picking up animal feces, including a stick member, a D-shaped handle mounted on the stick member at one end, a scoop assembly mounted on the stick member at an opposite end, and a control mechanism mounted on the D-shaped handle and controlled to open/close the scoop assembly, the improvement comprising a casing supported between the stick member and the scoop assembly to hold a roll of continuous sheet of poly bags, wherein the leading poly bag of the roll of continuous sheet of poly bag can be pulled out of the casing, then inserted into the inside of the scoop assembly through a slot thereon, and then hung on the scoop assembly in an open position for picking up animal feces.

6 Claims, 5 Drawing Sheets

PICK-UP DEVICE FOR PICKING UP ANIMAL FECES

CROSS REFERENCE TO RELATED APPLICATION

This invention is a continuation-in-part of U.S. patent application Ser. No. 08/347,728, filed Dec. 1, 1994, now pending.

BACKGROUND OF THE INVENTION

This invention relates to a picking-up scoop, more particularly, to a picking-up scoop for animals, such as the dog, during the walking.

Various pick-up devices have been disclosed for use to pick up animal feces, and have appeared on the market. U.S. Pat. No. 4,641,873 discloses a Sanitary Feces Collecting Device for this purpose. However, this structure of pick-up device is still not satisfactory in function because it must be operated by both hands. U.S. Pat. No. 4,248,468 discloses another structure of pick-up device, entitled "Litter and Retrieval Device", for picking up animal feces. This device can be operated by one hand, however the clamshell-like scoops cannot be maintained normally opened. When to open the clamshell-like scoops, the control handle must be lifted to overcome the spring force of the spring, which holds the scoops in the closed position. Furthermore, because the clamshell-like scoops are directly disposed in contact with the feces, they must be washed after each use.

U.S. patent application Ser. No. 08/347,728 discloses a picking-up scoop which eliminates the aforesaid drawbacks. As illustrated in FIGS. 1, 2, and 3, the picking-up scoop 1 comprises a stick member 2, a D-shaped handle 3 mounted on the stick member 2 at the top, a scoop 4 mounted on the stick member 2 at the bottom, a first actuating rod 5 longitudinally mounted within the stick member 2, a connecting shank 6 connected to the top end of the actuating rod, a second actuating rod 7 connected to the bottom end of the first actuating rod 5. When in use, the actuating button 34 is pressed to move the slide 32, causing the flange 322 to be released from the cutout 62, therefore the connecting shank 6 is forced downwards by the spring 75, and the scoop halves **4*a* and 4*b* are turned outwards to the open position. A poly bag can then be mounted on the scoop 4 and turned inside out with the border of the orifice hung on the tongue 4*a*1 and 4*b*1 on the scoop halves 4*a* and 4*b*. When the connecting shank 6 is lifted, the scoop halves 4*a*, 4*b*** are moved toward each other to pick up the feces by the poly bag. This structure of picking-up scoop is functional. However, it still cannot fully meet consumers' satisfaction because it has no room to hold poly bags, and the user must prepare poly bags separately for ready use.

SUMMARY OF THE INVENTION

The present invention has been accomplished under the circumstances in view. According to one aspect of the present invention, the pick-up device comprises a stick member, a D-shaped handle mounted on said stick member at one end, a scoop assembly mounted on said stick member at an opposite end, a control mechanism mounted on said D-shaped handle and controlled to open/close said scoop assembly, and a casing supported between the stick member and the scoop assembly to hold a roll of continuous sheet of poly bags for ready use. According to another aspect of the present invention, the casing has a coupling portion at the back side for fastening to the stick member. According to still another aspect of the present invention, the leading poly bag of the roll of continuous sheet of poly bag can be pulled out of the casing through an elongated slot on the lid of the casing, then inserted into the inside of the scoop assembly through an elongated slot thereon, and then hung on the scoop assembly in an open position for picking up animal feces. In an alternate form of the present invention, the scoop assembly has an upright mounting plate, and the coupling portion of the casing is made for fastening to the upright mounting plate directly.

DETAILED DESCRIPTION OF PREFERRED EMBODIMENT

Figure 1:
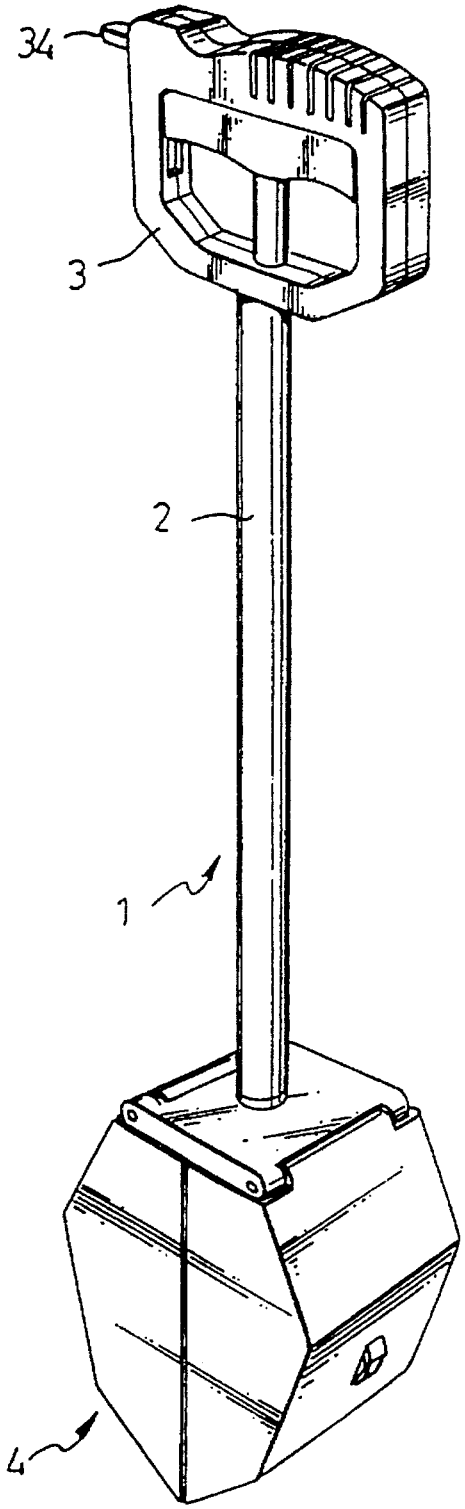
FIG. 1 is a perspective view of the picking-up scoop shown in U.S. patent application Ser. No. 08/347,728.
Figure 2:
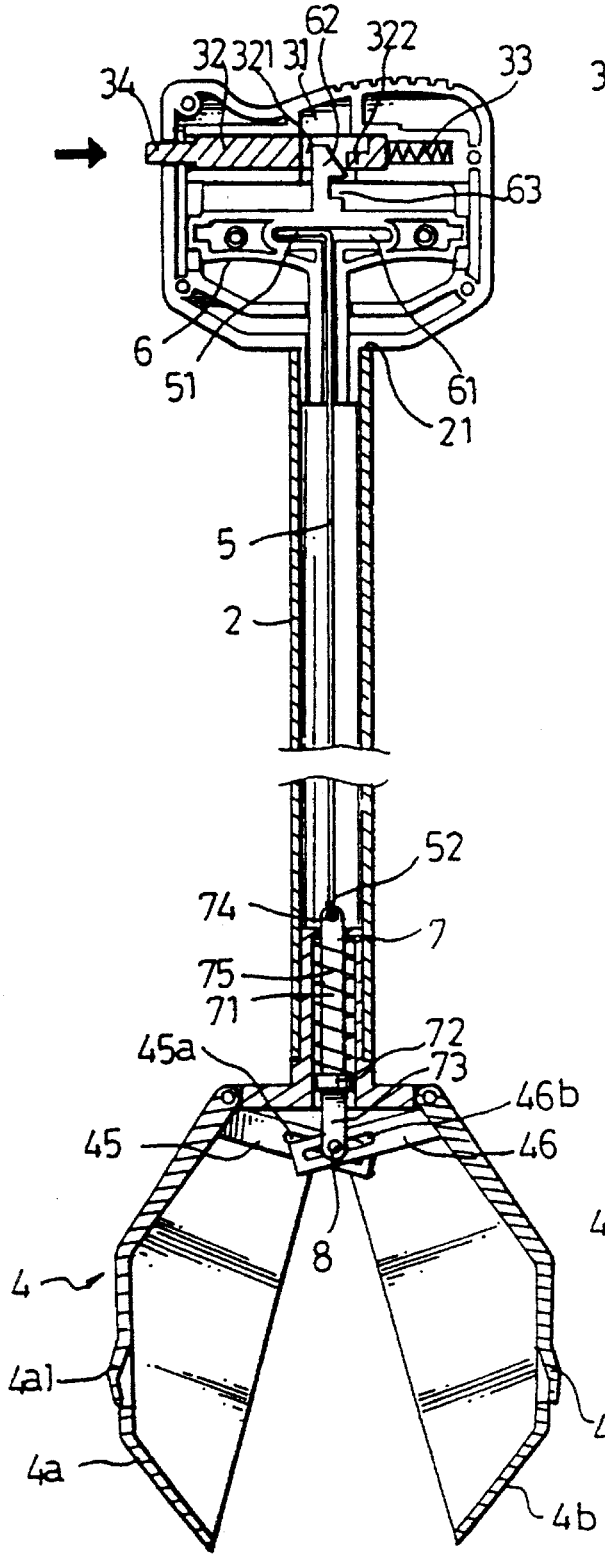
FIG. 2 is a longitudinal view in section the picking-up scoop shown in FIG. 1, showing the scoop opened.
Figure 3:
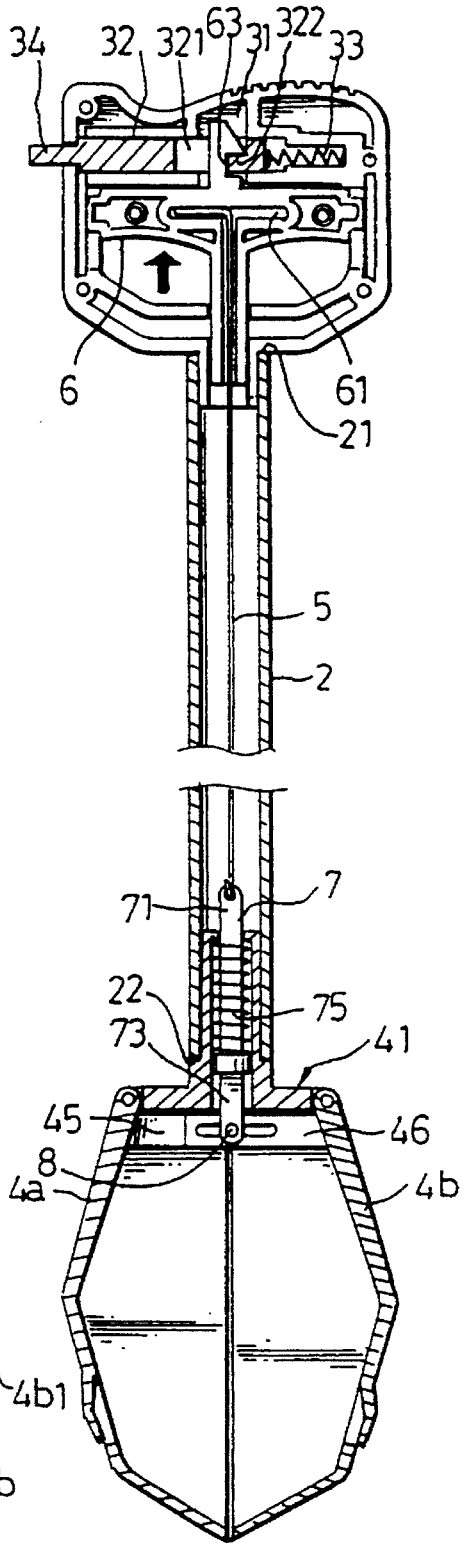
FIG. 3 is similar to FIG. 2 but showing the scoop closed.
Figure 4:
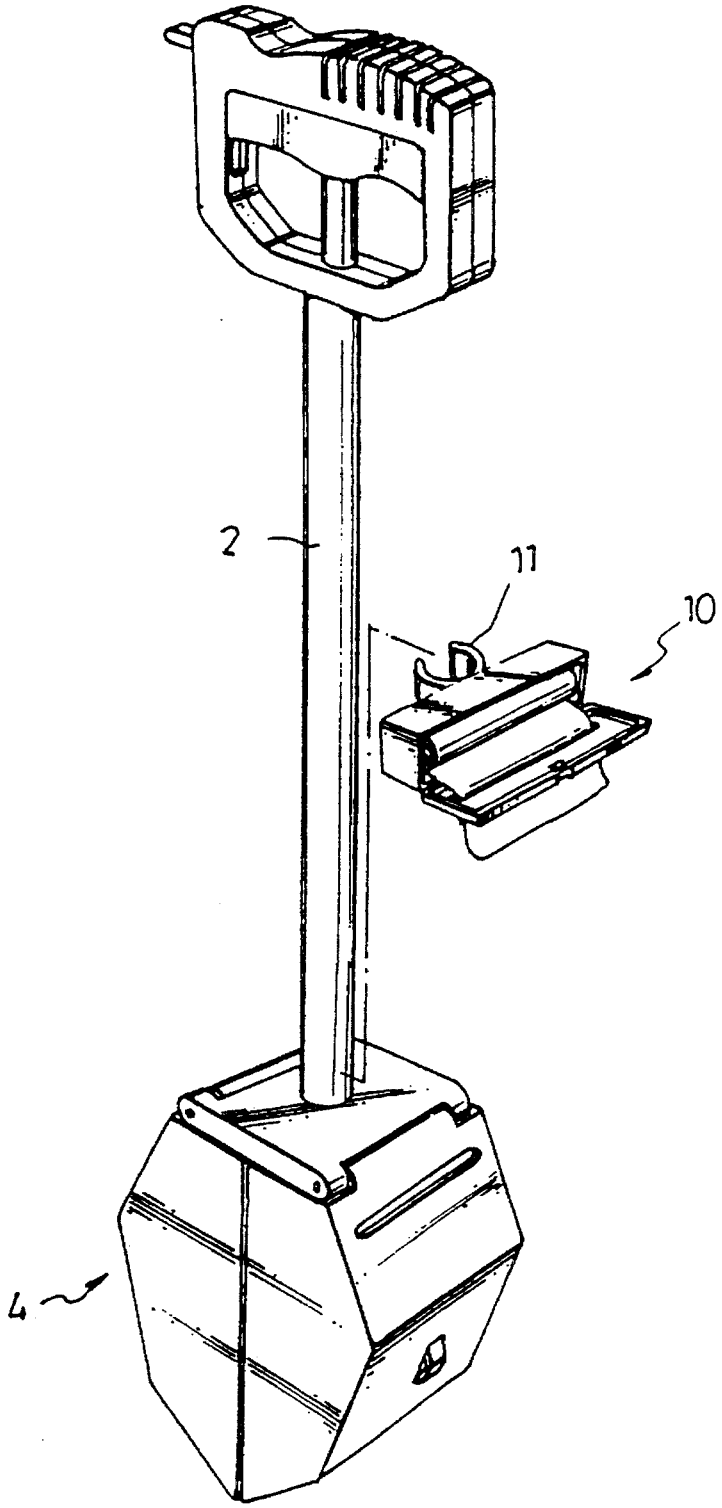
FIG. 4 is an exploded view of a pick-up device according to the present invention.

Referring to FIG. 4, a casing 10 is mounted on the stick member 2 above the scoop assembly 4 to hold a roll of continuous sheet of poly bags. The casing 10 comprises a coupling portion 11 at the back side for fastening to the stick member 2.

Figure 5:
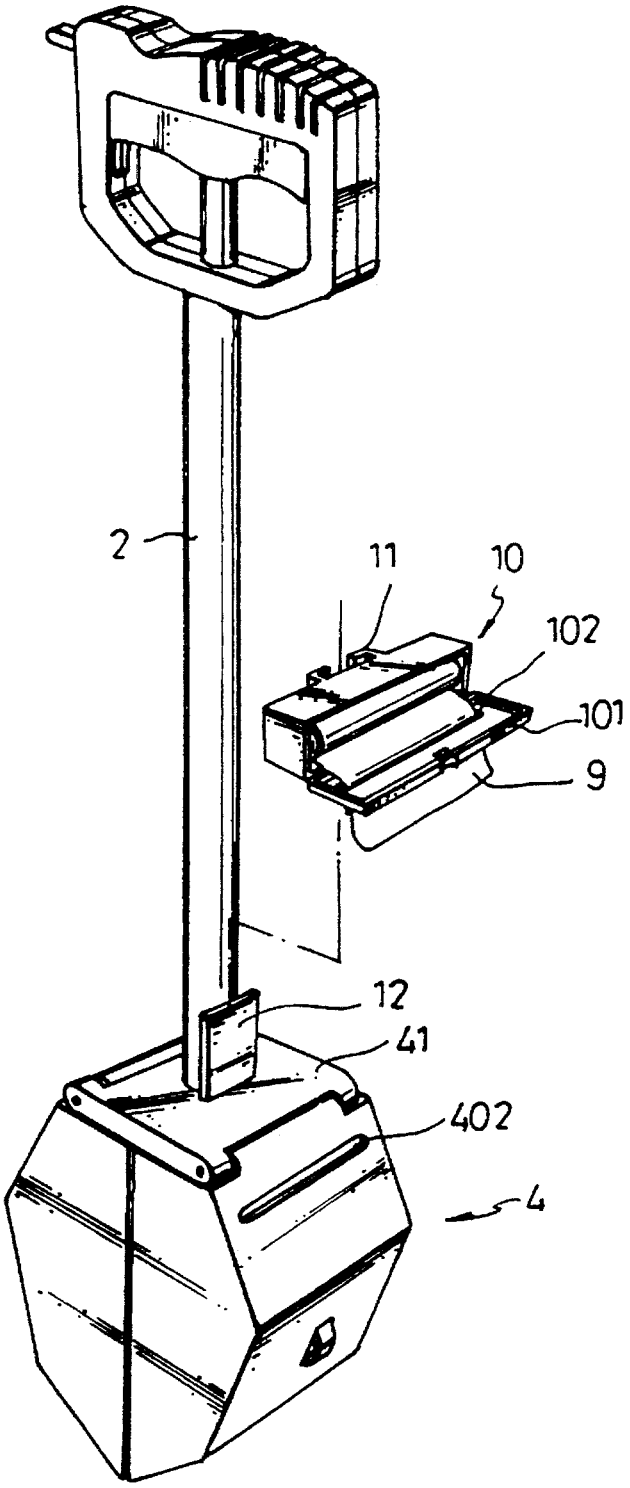
FIG. 5 is an exploded view of an alternate form of the present invention.

FIG. 5 shows an alternate form of the present invention. As illustrated, an upright mounting plate 12 is fixedly secured to the mounting bracket 41 of the scoop assembly 4. The coupling portion 11 of the casing 10 is made for fastening to the upright mounting plate 12 directly.

Referring to FIG. 5 again, the casing 10 holds a roll of continuous sheet of poly bags 9 on the inside, having a lid 101 and an elongated slot 102 on the lid 101. The leading poly bag of the roll of continuous sheet of poly bags 9 can be pulled out of the casing 10 through the elongated slot 102 on the lid 101, and then inserted into the inside of the scoop assembly 4 through an elongated slot 402 on the scoop assembly 4.

Figure 6:
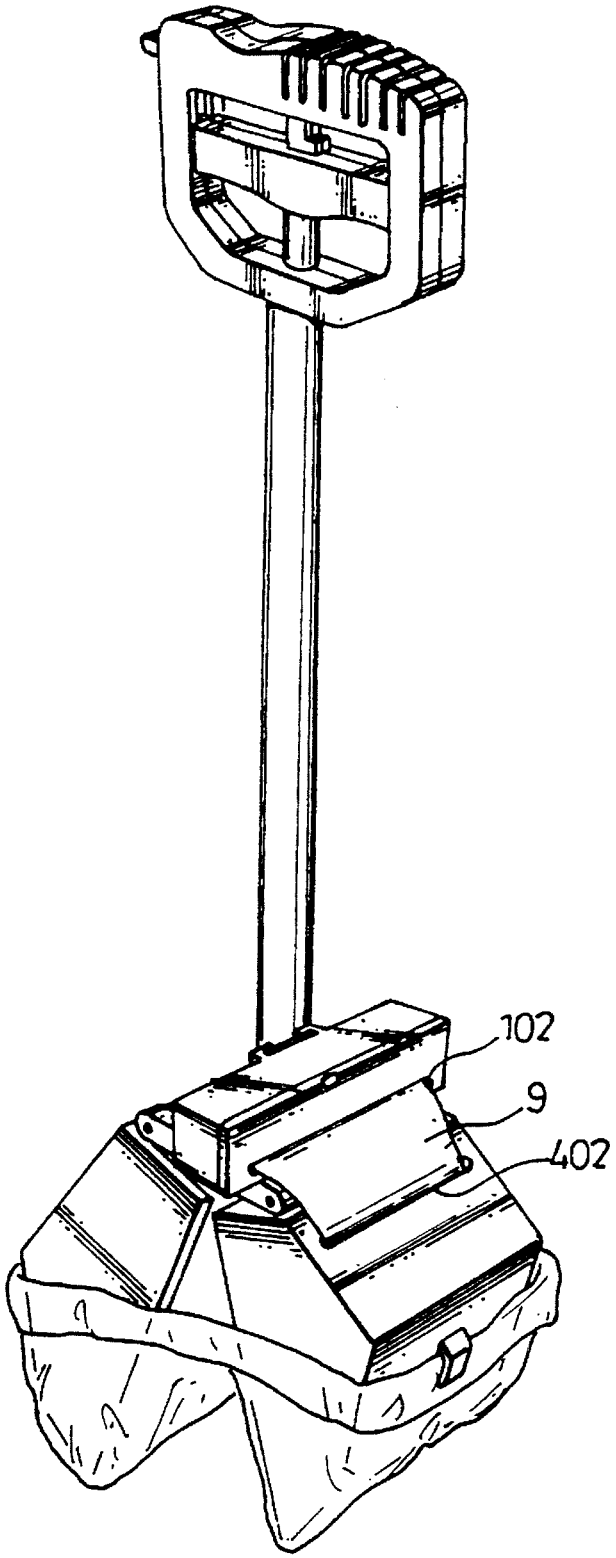
FIG. 6 is an assembly view of FIG. 5.

Referring to FIG. 6, when the leading poly bag of the roll of continuous sheet of poly bags 9 is inserted into the inside of tile scoop 4, it is turned inside out with the periphery of its orifice hung on the symmetrical halves of the scoop assembly 4 for picking up feces.

It is to be understood that the drawings are designed for purposes of illustration only, and are not intended as a definition of the limits and scope of the invention disclosed.

I claim:

1. A device for picking up animal feces, comprising a stick member, a D-shape handle mounted on said stick member at one end, a scoop assembly mounted on said stick member at an opposite end, and a control mechanism mounted on said D-shape handle and controlled to open/close said assembly, the improvement comprising a casing supported between said stick member and said scoop assembly to hold a roll of continuous sheet of poly bags, wherein said scoop assembly comprises an upright mounting plate at a top side thereof for mounting said casing, said casing comprises a coupling portion fastened to said upright mounting plate.

2. The device of claim 1 wherein said casing has a lid, and an elongated slot on said lid through which the leading poly bag of said roll of continuous sheet of poly bags can be pulled out of said casing for mounting on said scoop assembly for picking up animal feces.

3. The device of claim 1 wherein said scoop has an elongated slot at one side through which the leading poly bag of said roll of continuous sheet of poly bags can be inserted into the inside of said scoop assembly and turned inside out and then hung on said scoop assembly in an open position for picking up animal feces.

4. A device for picking up animal feces, comprising a stick member, a D-shape handle mounted on said stick member at one end, a scoop assembly mounted on said stick member at an opposite end, and a control mechanism mounted on said D-shape handle and controlled to open/close said assembly, the improvement comprising a casing supported between said stick member and said scoop assembly to hold a roll of continuous sheet of poly bags, said scoop has an elongated slot at one side through which the leading poly bag of said roll of continuous sheet of poly bags can be inserted into the inside of said scoop assembly and turned inside out and then hung on said scoop assembly in an open position for picking up animal feces.

5. The device of claim 4 wherein said casing has a lid, and an elongated slot on said lid through which the leading poly bag of said roll of continuous sheet of poly bags can be pulled out of said casing for mounting on said scoop assembly for picking up animal feces.

6. The device of claim 4, wherein said casing comprises a coupling portion at a back side thereof for fastening to said stick member.

* * * * *